US007628890B2

(12) United States Patent
Chupka et al.

(10) Patent No.: US 7,628,890 B2
(45) Date of Patent: Dec. 8, 2009

(54) EXTRACTION BEDPLATE WITH LASER OR WATER JET CUT APERTURES

(75) Inventors: David E. Chupka, Middletown, OH (US); Christopher L. Demler, Lebanon, OH (US)

(73) Assignee: Kadant Black Clawson Inc., Mason, OH (US)

( * ) Notice: Subject to any disclaimer, the term of this patent is extended or adjusted under 35 U.S.C. 154(b) by 784 days.

(21) Appl. No.: 10/466,308

(22) PCT Filed: Jul. 18, 2002

(86) PCT No.: PCT/US02/22872

§ 371 (c)(1),
(2), (4) Date: Oct. 12, 2004

(87) PCT Pub. No.: WO03/033152

PCT Pub. Date: Apr. 24, 2003

(65) Prior Publication Data

US 2005/0039615 A1 Feb. 24, 2005

Related U.S. Application Data

(60) Provisional application No. 60/330,357, filed on Oct. 18, 2001.

(51) Int. Cl.
*D21B 1/32* (2006.01)

(52) U.S. Cl. ..... 162/261; 100/104; 162/28; 162/55; 241/24.1; 241/46.02

(58) Field of Classification Search ..... 162/28, 162/55, 261; 209/659, 669, 713; 241/24.1, 241/46.11, 24.11, 24.19, 24.21, 24.29, 28, 241/46.02, 46.17, 43, 69
See application file for complete search history.

(56) References Cited

U.S. PATENT DOCUMENTS

| | | | | |
|---|---|---|---|---|
| 2,641,971 | A | 6/1953 | Ellis | |
| 3,035,781 | A | 5/1962 | Wallen | |
| 3,774,853 | A | 11/1973 | Seifert | |
| 3,843,063 | A | 10/1974 | Honeyman | |
| 3,877,648 | A | 4/1975 | Vokes | |
| 4,222,817 | A * | 9/1980 | Clark et al. | 209/211 |
| 4,254,878 | A * | 3/1981 | Marsh | 209/682 |
| 4,582,261 | A | 4/1986 | Perry | |
| 4,593,861 | A | 6/1986 | Blakley et al. | |
| 4,725,007 | A * | 2/1988 | Chupka | 241/46.02 |
| 4,885,090 | A | 12/1989 | Chupka et al. | |
| 5,064,537 | A | 11/1991 | Chupka et al. | |
| 5,839,207 | A | 11/1998 | Christensen et al. | |
| 5,918,822 | A * | 7/1999 | Sternby | 241/46.17 |
| 5,927,624 | A | 7/1999 | Hughes | |
| 5,996,917 | A | 12/1999 | Ehrle et al. | |
| 6,000,840 | A | 12/1999 | Paterson | |
| RE36,486 | E | 1/2000 | Hughes | |
| 6,053,439 | A * | 4/2000 | Locke et al. | 241/20 |
| 6,094,795 | A | 8/2000 | Davenport | |
| 6,234,415 | B1 * | 5/2001 | Liin | 241/46.11 |
| 6,254,729 | B1 | 7/2001 | Doelle et al. | |

FOREIGN PATENT DOCUMENTS

| | | |
|---|---|---|
| CN | 2069430 U | 1/1991 |
| CN | 2107484 U | 6/1992 |
| WO | WO 00/09799 | 2/2000 |

OTHER PUBLICATIONS

Letter to Applicants' Attorney (1 page).
Laico.com Web Pages (11 pages).
Waterjet-tech Web Pages (2 pages).
Waterjet.org Web Pages (5 pages).
Tampella Rotor Advertisement (with English language handwritten notes) (1 page).
Slush Motor Advertisement (with handwritten notes) (1 page).
Brute Motor Works Advertisement (with handwritten notes) (1 page).
Baracuda Pulping Unit Designs Advertisement (with handwritten notes) (1 page).
Spappolatori A Bassa Densita—Low Consistency Pulpers Advertisement (1 page).
Beloit Jones Horizontal Barracuda and Shark Pulpers Advertisement (1 page).

* cited by examiner

*Primary Examiner*—Mark Halpern
(74) *Attorney, Agent, or Firm*—Wegman, Hessler & Vanderburg

(57) ABSTRACT

The present invention relates to extraction bedplates (10), (110), (210), (310), (410), (510), (610) for use in apparatus (5) for defiberizing paper making stock and methods for making such bedplates. Preferred methods for making such bedplates (10), (110), (210), (310), (410), (510), (610) include the step of cutting a disc shaped blank from a metal plate and the step of forming holes (45), (145), (245), (345), (445), (545), (645), (646) either the metal plate or the disc shaped blank. The holes (45), (145), (245), (345), (445), (545), (645), (646) preferably are formed using a cutting stream, most preferably either a laser or a water jet. Use of a cutting stream to form the holes facilitates the cutting of holes (45), (145), (245), (345), (445), (545), (645), (646) having non-circular, and preferably tesselatory, cross sections as well as holes (45), (145), (245), (345), (445), (545), (645), (646) extending at acute angles with respect to an axis (20) of the bedplate.

8 Claims, 7 Drawing Sheets

EXTRACTION BEDPLATE WITH LASER OR WATER JET CUT APERTURES

CROSS-REFERENCE TO RELATED APPLICATIONS

Priority filing benefit of (1) International PCT application PCT/US02/22872 filed Jul. 18, 2002, and published under PCT 21(2) in the English language and (2) U.S. Provisional Application Ser. No. 60/330,357 filed Oct. 18, 2001.

BACKGROUND OF THE INVENTION

1. Field of the Invention

The present invention relates to apparatus for use in defiberizing papermaking stock. More particularly, the invention relates to extraction bedplates with specially shaped and contoured holes cut by laser energy or a fluid jet for use in pulping apparatus.

2. Background Art

Apparatus for pulping paper making stock is shown in Chupka U.S. Pat. No. 4,725,007, the disclosure of which is incorporated by reference. The apparatus shown in U.S. Pat. No. 4,725,007 includes a tub and a rotor mounted within the tub for inducing shear forces which serve to defiberize the stock. An extraction bedplate is positioned at the bottom of this tub, surrounded by a frusto-conical wall which serves as a funnel to direct the stock toward the bedplate. The preferred bedplate is disc-shaped, defining an upstream surface facing into the tub; a downstream surface facing oppositely from the upstream surface; and holes or apertures extending through the bedplate from the upstream surface to the downstream surface. The rotor is mounted near the center of the perforated bedplate and coupled to a motor for rotation about an axis normal to the upstream surface of the bedplate.

The holes extending through the extraction bedplate allow accepted fiber, that is, pulp which has been defiberized to a degree which is acceptable for further processing to flow out from the apparatus, while retaining larger, undefiberized particles and other solids in the tub. Conventional bedplates typically range from 24 inches (61 cm) to 96 inches (2.4 m) in diameter and are typically approximately ⅝ inch (1.6 cm) thick. Typically there are 4,000 to 5,000 holes in a 96 inch diameter plate with ⅝ inch holes. Since such holes are formed by conventional drilling processes, they have in the past been formed parallel to the axis of the bedplate with circular cross sections. The holes generally range from ⅛ inch (3.2 mm) to 1 inch (25 mm) in diameter.

Known extraction bedplates tend to be high maintenance items because of wear. Bedplates are exposed to harsh treatment from sand, metal objects and other debris contained within the stock. The typical clearance between the rotor and the bedplate is approximately 0.060 inch (1.5 mm) to 0.120 inch (3.0 mm). The stock is constantly pushed against, and drug along, the upper surface of the bedplate by the mechanical and hydraulic action of the associated rotor. The accepted fiber along with small contaminates which flow through the bedplate contribute to wear within the holes, particularly near the upper perimeters of the downstream edge portions of the holes.

Bedplates typically are manufactured from steel alloys resistant to wear and corrosion. Various stainless steels and 410 hard chrome steel have been used in forming bedplates. The 410 hard chrome steel is preferred because it is more wear resistant than the stainless steels. On the other hand, the 410 hard chrome steel requires heat treatment to harden the material to restore acceptable wear resistance after known machining and hole-drilling steps are performed. Once the heat treatment is performed, further machining is possible only with special tools in a slow and costly procedure. The heat treatment itself tends to warp the steel, so that additional manufacturing steps are required to straighten the bedplate.

The defibering characteristics of a given bedplate are dependent to a large degree on the surface indentations defined by the upper edges of the individual holes. More particularly, the paper making stock flows over the upstream surface of the bedplate during operation of the pulping apparatus. Hydraulic shear is generated near downstream side edges (that is, edges facing the oncoming stock now) formed at the intersections of the holes with the upstream surface of the bedplate. This hydraulic shear acts to break up relatively large, undefiberized particles. Increasing the number of such downstream side edges increases the amount of the hydraulic shear, thus improving the efficiency of the pulping apparatus.

Therefore, there remains a need in the art for extraction bedplates providing improved efficiency and wear resistance. Additionally, there remains a need for improved methods for making such bedplates.

SUMMARY OF THE INVENTION

Preferred extraction bedplates in accordance with the present invention have specially shaped and configured holes which provide increased densities of downstream side edges along the upstream surfaces of the bedplates. In accordance with one preferred embodiment of the invention, the holes have non-circular cross sections. Most preferably, the holes have cross sections with shapes which tessellate a plane, that is, which when laid side-to-side will fill a plane without intervening gaps. Individual holes having tesselatory cross sections can be arranged closely to one another, thereby improving the density of the downstream side edges on the upstream surface of the bedplate and increasing the amount of hydraulic shear acting on the unfiberized stock.

Especially preferred hole cross sectional shapes include rhombi (that is, "diamond shapes"), squares, rectangles, triangles and chevrons. Other preferred shapes include crescents and semi-circles which, though not tesselatory, can be closely arranged on the bedplate surface so as to improve the density of the downstream side edges.

In accordance with another preferred embodiment, the holes extend from one of the upstream and downstream surfaces to the other at an acute angle relative to an axis normal to the upstream and downstream surfaces. Preferably, the holes extend in a pattern combining a helical arrangement with a radial splay so as to present relatively sharp side edges facing into the stock flow immediately above the upstream surface of the bedplate. Most preferably, the holes are arranged along arcs or curves coincident with anticipated stock flow lines immediately above the upstream surface of the bedplate and are oriented such that the holes extend into the bedplate and in the anticipated flow direction of the stock so as to present the sharpest possible downstream side edges to the flow. This arrangement serves to reduces the drag on the flow of accepts fiber through the bedplate and improve the generation of hydraulic shear near the upstream surface.

In accordance with yet another preferred embodiment of the invention, the bedplate is fabricated by forming a disc-shaped blank from a metal plate and then forming the holes, preferably by means of a cutting stream. One preferred cutting stream is an energy stream, such as a stream of laser or other electromagnetic energy. Another preferred stream is a pressurized fluid stream such as a water jet. The use of such cutting streams to form the holes simplifies the manufacture of the bedplates and reduces the both time and cost of manufacture. The method also facilitates the cutting of the specially shaped and configured holes to improve the density and sharpness of the downstream side edges facing the stock flow. The method can be practiced on highly wear resistance materials without the heat treatments or special tools required by prior art methods. Since the method is adapted for use with stronger, more wear resistant steels than those typically used in the prior art, it provides for the fabrication of thinner bedplates and of bedplates having useful lives longer than those typical in the prior art.

Further advantages, objects and features of the present invention will become apparent in the following detail description when considered together with the drawing figures and appended claims.

DETAIL DESCRIPTION OF THE INVENTION

Figure 1:
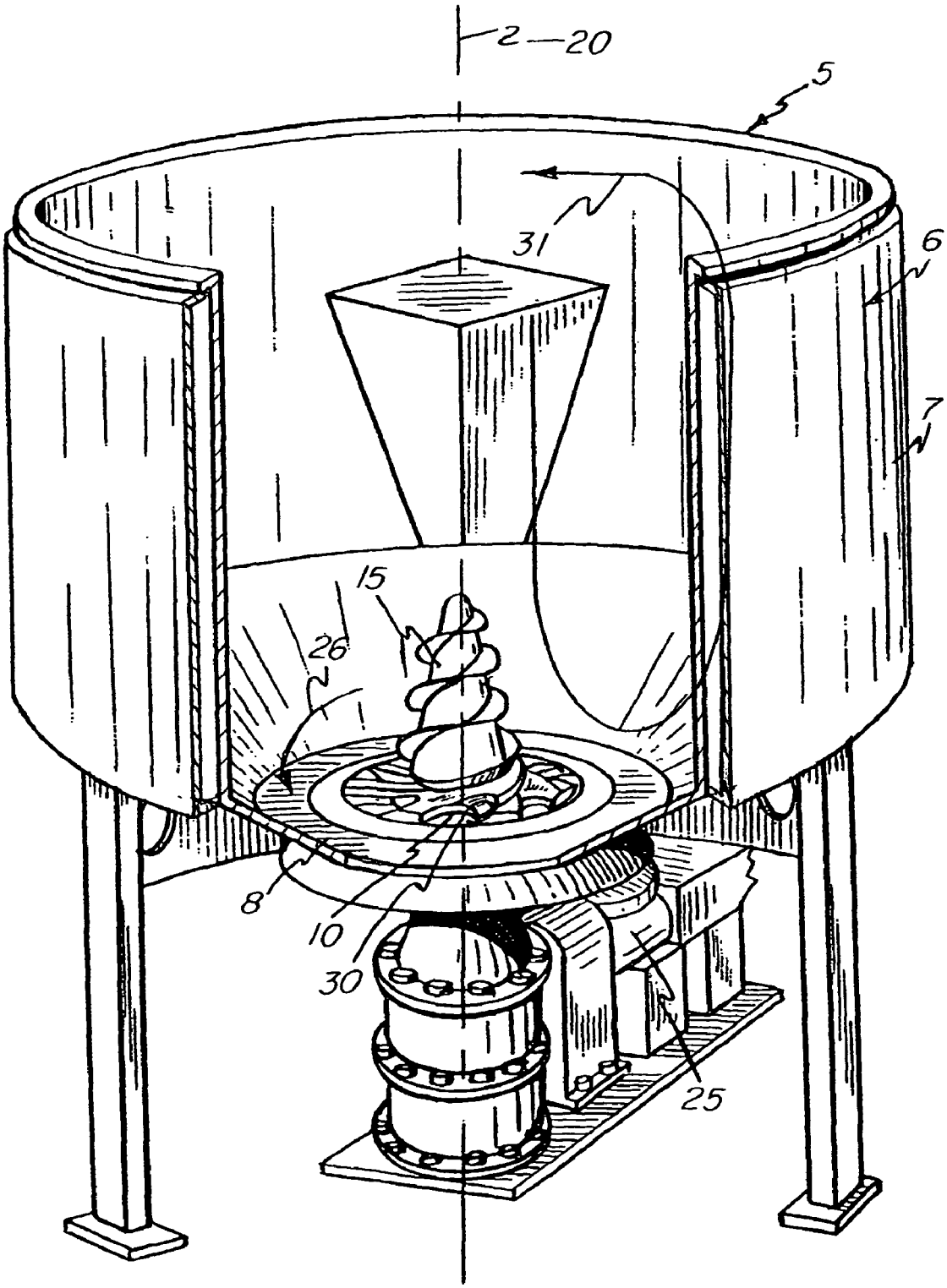
FIG. 1 is a perspective view of pulping apparatus partially cut away to show an extraction bedplate in accordance with the present invention.

Referring initially to FIG. 1, there is shown a pulping apparatus 5 of a type used in the paper making industry to defiberize paper making stock (not shown). The pulping apparatus 5 includes a tub 6 defining a side wall 7; an extraction bedplate 10 located along a bottom wall 8 of the tub 6; and a rotor 15 proximate the bedplate 10. The clearance between the bedplate 10 and the rotor 15 is approximately 0.060 inch (1.5 mm) to 0.120 inch (3.0 mm).

The rotor 15 is mounted for rotation about an axis 20. A drive motor 25 is coupled to the rotor 15 to rotate the rotor 15 about the axis 20 in a direction 26 so as to force the paper making stock (not shown) to flow over a substantially planar first or upstream surface 30 of the bedplate 10.

As the rotor 15 rotates, it not only forces the paper making stock (not shown) against the upstream surface 30 of the bedplate 10 but also drags the stock along the upper surface 30 in the direction of motion of the rotor 15. As the stock (not shown) drags along the upper surface 30, hydraulic shear generated between the rotor 15 and the bedplate 10 serves to defiberize the stock. Defiberized stock (not shown) flows through the bedplate 10 to an accepts conduit (not shown) while larger, undefiberized stock and other solids (not shown) remain within the tub 6 for further processing.

The pattern of the stock flow (not shown) within the preferred pulping apparatus 5 is a combination of a first circulatory component having a flow direction indicated generally by the arrow 31 and a second circulatory component flowing in the direction of the arrow 26 about the axis 20. The first circulatory component, as indicated generally by the arrow 31, moves downwardly in the region immediately surrounding the central axis 20; radially outwardly near the rotor 15 and the upstream surface 30 of the bedplate 10; upwardly along the outer perimeter of the pulping apparatus 5; and then inwardly toward the central axis 20. The resulting flow pattern (not shown) immediately above the upstream surface 30 follows flow lines symmetric about the axis 20 which lead in an arcuate or curved manner away from the axis 20 toward the side wall 7 of the tub 6.

Figure 2:
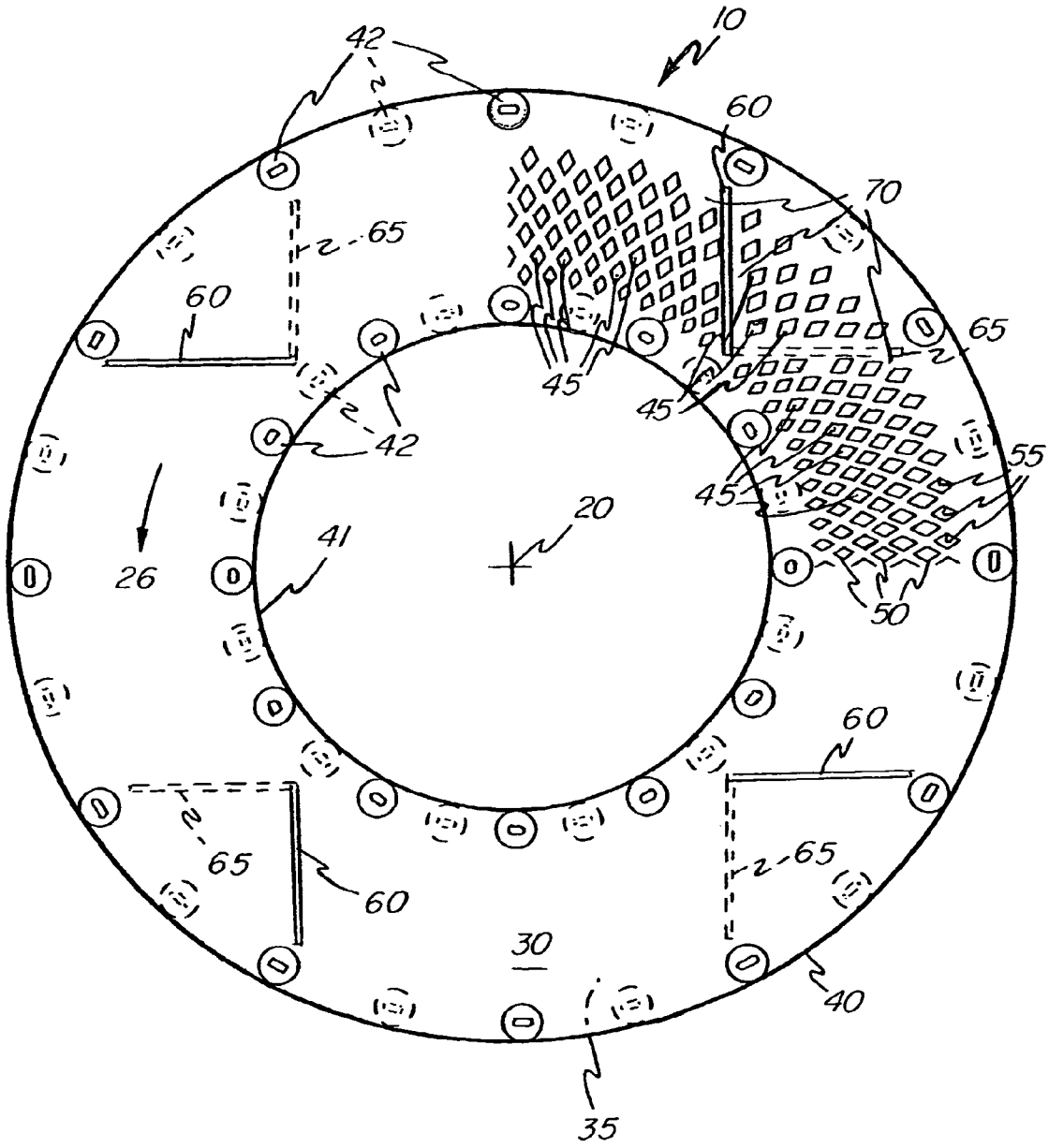
FIG. 2 is a schematic view of a first preferred extraction bedplate in accordance with the present invention.

Turning to FIG. 2, a first preferred extraction bedplate 10 in accordance with the present invention is disc shaped, comprising the first or upstream surface 30; a substantially planar second or downstream surface 35; a circumferential surface 40; and a circular central opening 41 for accommodating the rotor 15 (FIG. 1). The axis 20 extends normally to the upstream and downstream surfaces 30, 35. A plurality of mounting holes 42 provide means for securing the bedplate 10 in the pulping apparatus 5 (FIG. 1).

A plurality of holes or apertures 45 extend through the bedplate 10 from the upstream surface 30 to the downstream surface 35. Each hole 45 defines an perimeter 50 where the hole 45 intersects the upstream surface 30. Each such perimeter 50 defines a downstream side edge 55.

The bedplate 10 has wearstrips 60, 65 positioned on the upstream and downstream surfaces 30, 35, respectively. The wearstrips 60, 65 preferably are shaped as elongated rectangles. They are arranged in pairs, one each on the upstream and downstream surfaces 30, 35, extending perpendicularly or obliquely with respect to the other so as to define angles opening outwardly toward the circumferential surface 40. The wearstrips 60, 65 preferably are mounted on land areas 70 substantially free of holes 45 on the upstream and downstream surfaces 30, 35.

The wearstrips 60, 65 provides several advantages. First, the wearstrips 60, 65 serve to protect the upstream surface 30 of the bedplate 10 from wear due to the action of the rotor 15 (FIG. 1) and the stock flow (not shown). Second, the wearstrips 60, 65 provide visual indications of the relative wear of the upstream and downstream surfaces 30, 35, respectively, and of the downstream portions 55 of the holes 45. Third, the wearstrips 60, 65 are oriented so as to baffle the flow immediately above the upstream surface 30 toward a desired direction within the pulping apparatus 5.

Figure 3:
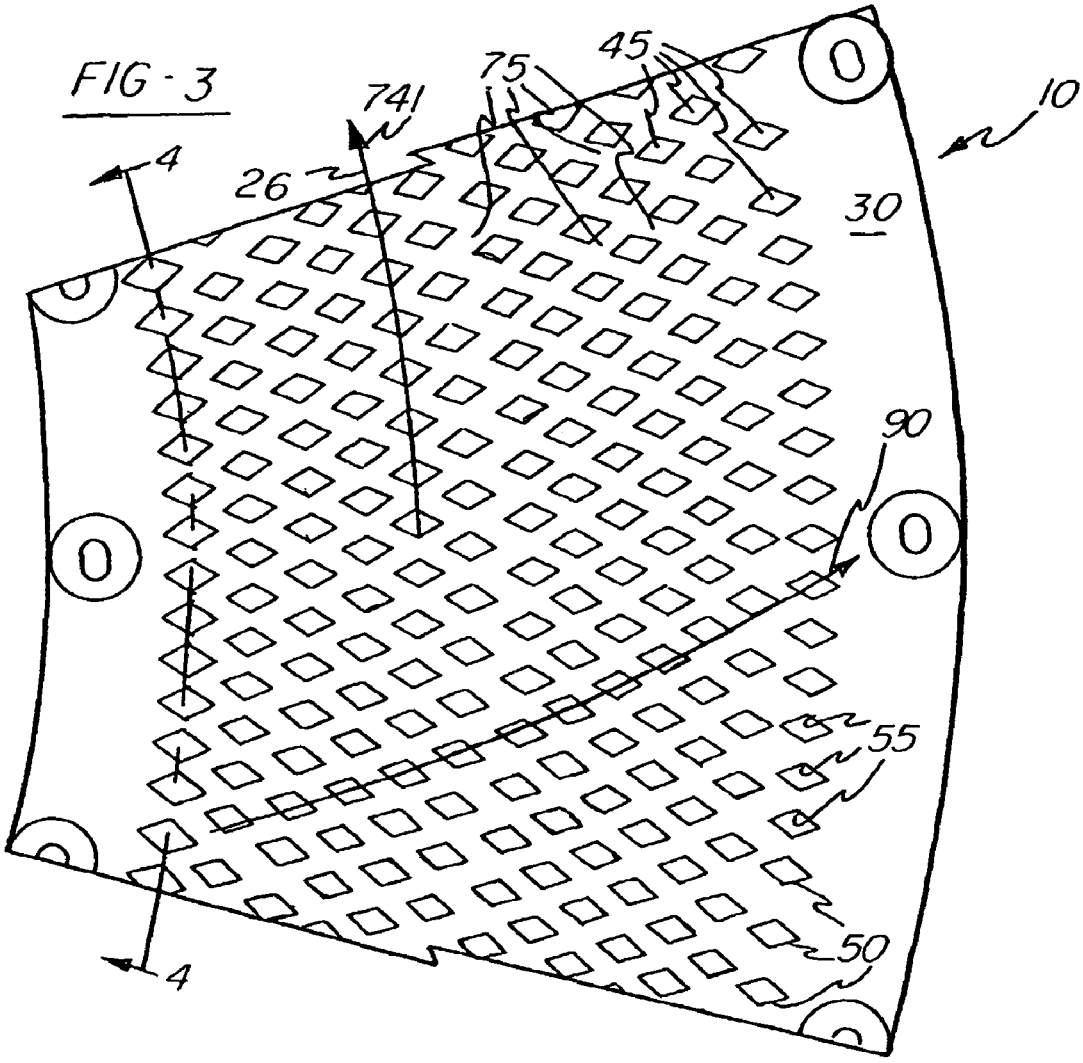
FIG. 3 is a plan view of a portion of the extraction bedplate of FIG. 2.

The holes 45 of the first preferred bedplate 10 have rhombic cross sections arranged such that major diagonals of the rhombi extend radially with respect to the axis 20. As shown in FIG. 3, the holes 45 are arranged in rings extending annularly around the bedplate 10. Webs 75 defining land areas on the upstream and downstream sides 30, 35 (FIG. 2) connect adjacent holes 10. The use of holes 45 having rhombic cross sections arranged in annularly extending rings minimizes the sizes of the land areas defined by the webs 75 and improves the density of the holes on the upstream and downstream surfaces 30, 35 (FIG. 3) of the bedplate 10. Most preferably, the holes 45 are arranged in a series of arcs or curves 90 coincident with the anticipated direction of the stock flow (not shown) immediately above the upstream surface 30 (FIG. 2).

Figure 4:
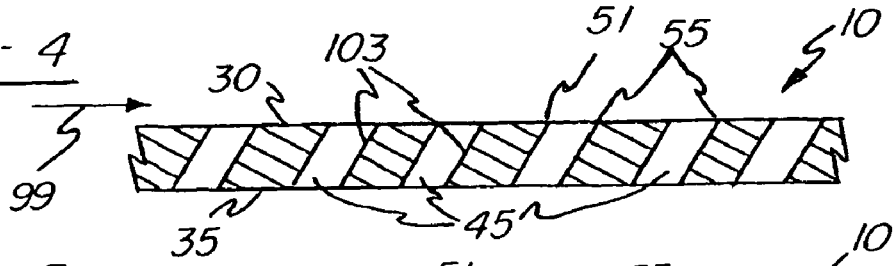
FIG. 4 is a sectional view of the extraction bedplate of FIG. 2, taken along the line 4-4 of FIG. 3.
Figure 5:
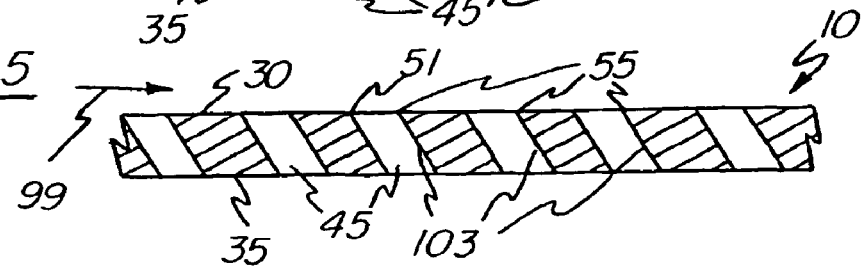
FIG. 5 is a sectional view of the extraction bedplate of FIG. 2, taken along the line 5-5 of FIG. 3.

As shown in FIG. 4, the holes 45 extend through the first preferred bedplate 10 at an obtuse angle relative to surfaces 30, 35; that is, they extend at an acute angle relative to the axis 20 (FIGS. 1 and 2). Furthermore, the extensions of the holes 45 through the bedplate 10 are symmetric with respect to the axis 20 (FIGS. 1 and 2). Most preferably, the holes 45 extend in a pattern combining a helical arrangement, as indicated in FIG. 4, with a radial splay, as indicated in FIG. 5, so that the downstream side edges 55 of the holes 45 facing into the direction 90 of the flow of stock (not shown) immediately above the upstream surface 30 are sharper or more knife-like than downstream side edges (not shown) of corresponding holes (not shown) extending perpendicularly to the upstream and downstream surfaces 30, 35 would be. This arrangement, wherein the downstream side edges 55 of the holes 45 facing into the anticipated direction 90 of the flow of stock (not shown) immediately above the upstream surface 30 are relatively sharp, decreases the drag on the defiberized stock (not shown) flowing through the holes 45 to the accepts conduit (not shown) while serving to generate hydraulic shear (not shown) to defiberize larger, undefiberized particles (not shown) in the stock.

While the surfaces 30, 35 have been described as an "upstream surface" and a "downstream surface," respectively, those skilled in the art will note that the first preferred bedplate 10 is reversible so as to face either of the two surfaces 30, 35 into the pulping apparatus 5 (FIG. 1) during use. Thus, it is possible to install the bedplate 10 in the pulping apparatus 5 (FIG. 1) such that the "upstream surface" 30 faces upstream toward the rotor 15 (FIG. 1) and to operate the pulping apparatus 5 (FIG. 1) until the "upstream surface" 30 undergoes a specific degree of wear. The, it is possible to reverse the bedplate 10 such that the formerly "downstream surface" 35 faces upstream toward the rotor 15 (FIG. 1).

It will be understood that the particular shapes, sizes, configurations, number and arrangement of the holes 45 shown in FIGS. 2-5 is not critical to the invention and that other suitable shapes, sizes, configurations, numbers and arrangements of holes (not shown) will be apparent to those of ordinary skill in the art.

A second preferred extraction bedplate in accordance with the present invention includes holes having circular cross sections. The holes extend from a substantially planar first or upstream surface to an opposed substantially planar second or downstream surface at an obtuse angle with respect to a substantially planar upstream surface, that is, at an acute angle with respect to the axis 20 (FIG. 1), in the manner illustrated in FIGS. 4 and 5. Most preferably, the holes extend in a pattern combining a helical arrangement with a radial splay such that downstream side edges of the holes facing into the anticipated direction of the flow of stock (not shown) immediately above the upstream surface are relatively sharp. The resulting bedplate is reversible. It will be understood that the particular shapes, sizes, configurations, number and arrangement of the holes is not critical to the invention and that other suitable shapes, sizes, configurations, numbers and arrangements of holes (not shown) will be apparent to those of ordinary skill in the art.

Figure 6:
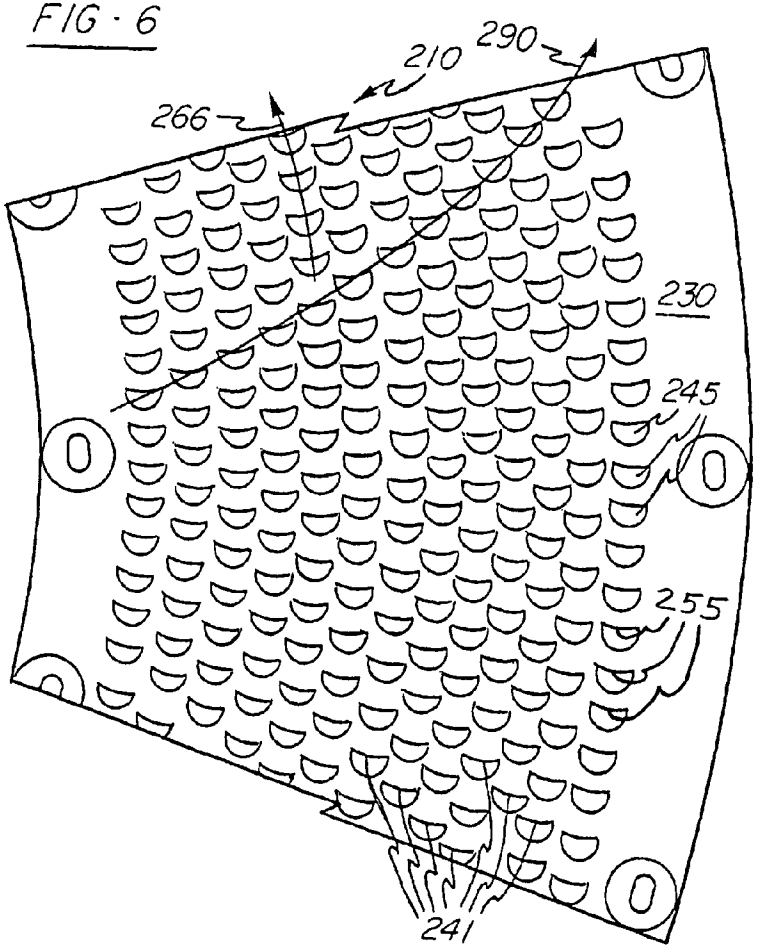
FIG. 6 is a plan view of a portion of a second preferred extraction bedplate in accordance with the present invention with holes having circular cross sections extending at an acute angle with respect to a radius normal to the upstream and downstream surfaces thereof.

Likewise, in FIG. 6, a third preferred extraction bedplate 210 in accordance with the present invention includes holes 245 having crescentic cross sections arranged in annular rings such that concave faces 241 of the cross sections face the anticipated direction 266 of rotation of the rotor 15 (FIG. 1). Preferably, the holes 245 extend from a substantially planar first or upstream surface 230 to an opposed substantially planar second or downstream surface (not shown) in parallel, or at an acute angle, with respect to the axis 20 (FIG. 1). Most preferably, the holes 245 are arranged along arcs or curves 290 coincident with anticipated stock flow lines (not shown) immediately above the upstream surface 230 of the bedplate 210 and are oriented such that the holes 245 present the sharpest possible downstream side edges 255 to the anticipated stock flow (not shown). Once again, it will be understood that the particular shapes, sizes, configurations, number and arrangement of the holes 245 shown in FIG. 6 is not critical to the invention and that other suitable shapes, sizes, configurations, numbers and arrangements of holes (not shown) will be apparent to those of ordinary skill in the art.

Figure 7:
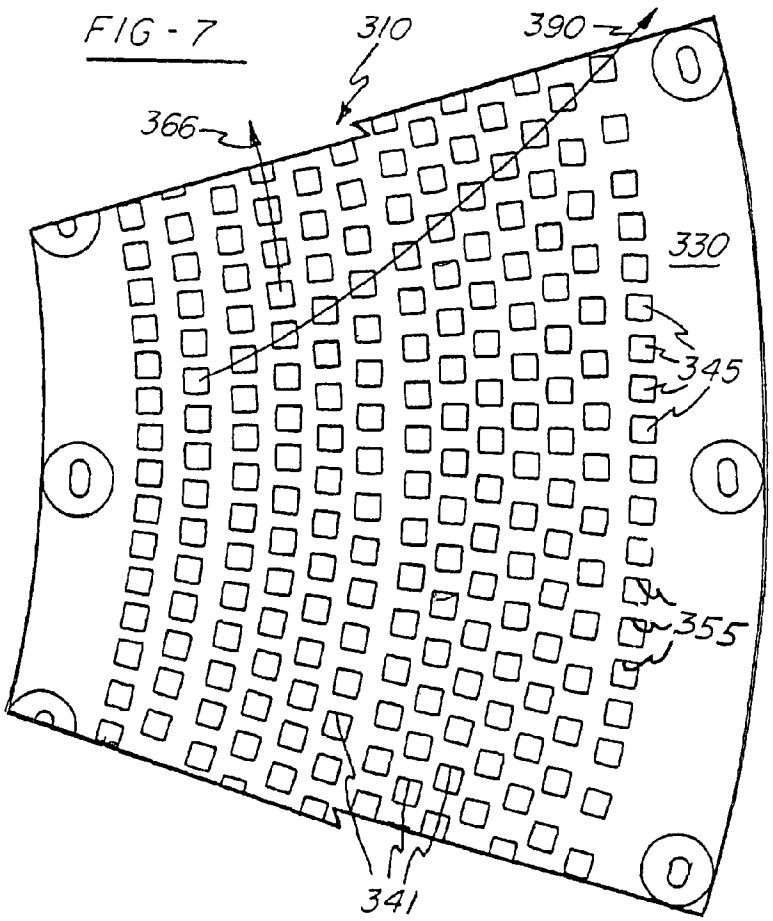
FIG. 7 is a plan view of a portion of a third preferred extraction bedplate in accordance with the present invention with holes having crescentic cross sections.

Likewise, in FIG. 7, a fourth preferred extraction bedplate 310 in accordance with the present invention includes holes 345 having square cross sections. Preferably, the holes 345 extend from a substantially planar first or upstream surface 330 to an opposed substantially planar second or downstream surface (not shown) in parallel, or at an acute angle, with respect to the axis 20 (FIG. 1). Most preferably, the holes 345 are arranged along arcs or curves 390 coincident with anticipated stock flow lines (not shown) immediately above the upstream surface 330 of the bedplate 310 and are oriented such that the holes 345 present the sharpest possible downstream side edges 355 to the anticipated stock flow (not shown). Once again, it will be understood that the particular shapes, sizes, configurations, number and arrangement of the holes 345 shown in FIG. 7 is not critical to the invention and that other suitable shapes, sizes, configurations, numbers and arrangements of holes (not shown) will be apparent to those of ordinary skill in the art.

Figure 8:
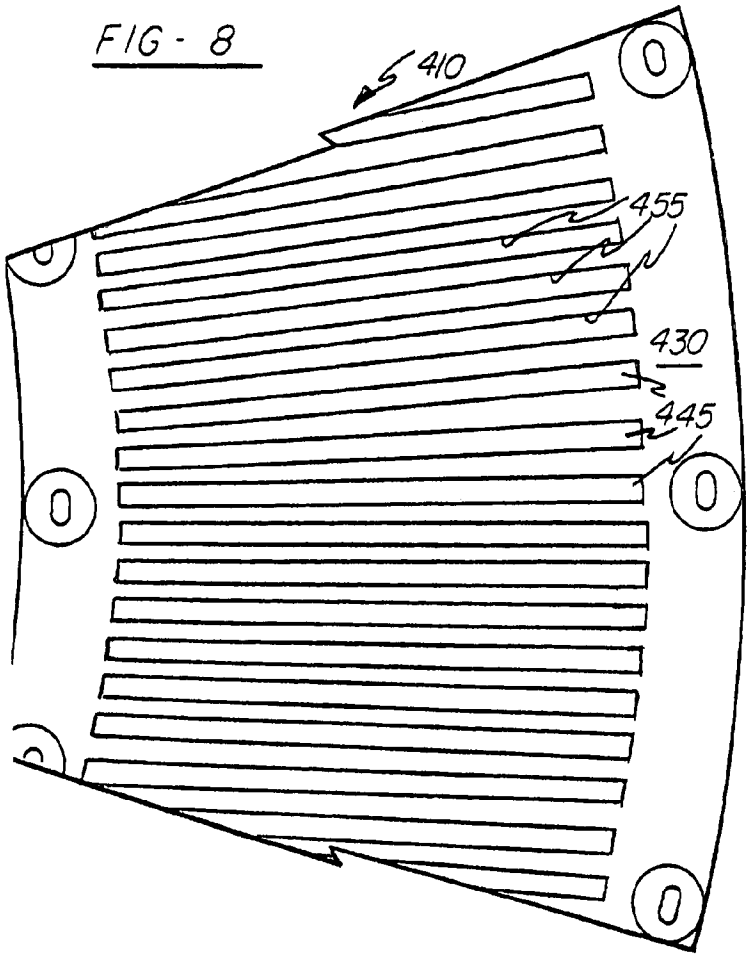
FIG. 8 is a plan view of a portion of a fourth preferred extraction bedplate in accordance with the present invention with holes having square cross sections.

Turning to FIG. 8, a fifth preferred extraction bedplate 410 in accordance with the present invention includes elongated rectangular slots or holes 445 arranged in an angular ring. Preferably, the rectangular slots 445 are arranged such that longer side edges 455 of the slots 445 extend radially with respect to the axis 20 (FIG. 1). Most preferably, the holes 445 extend helically, or in a pattern combining a helical arrangement with a radial splay, from the a substantially planar first or upstream surface 430 to a substantially planar second or downstream surface (not shown) such that the side edges 455 of the holes 445 are relatively sharp. Once again, it will be understood that the particular shapes, sizes, configurations, number and arrangement of the holes 445 shown in FIG. 8 is not critical to the invention and that other suitable shapes, sizes, configurations, numbers and arrangements of holes (not shown) will be apparent to those of ordinary skill in the art.

Figure 9:
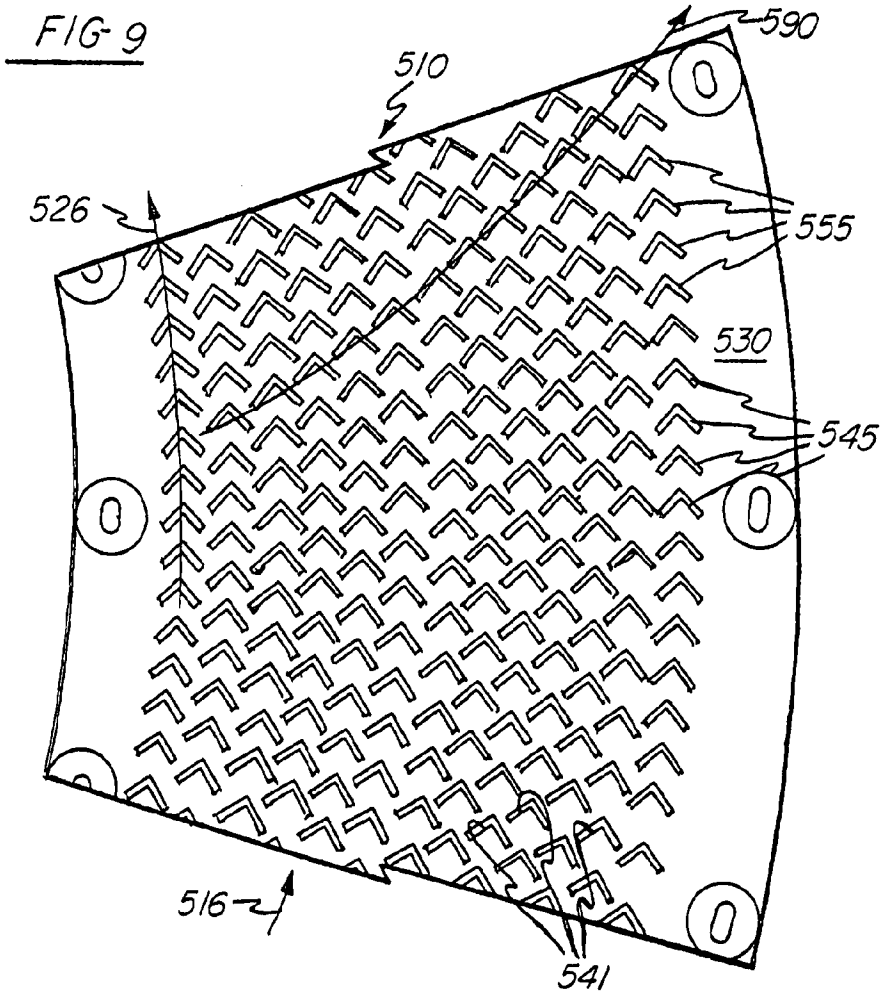
FIG. 9 is a plan view of a portion of a fifth preferred extraction bedplate in accordance with the present invention with rectangular slots or holes.

Likewise, in FIG. 9, a sixth preferred extraction bedplate 510 in accordance with the present invention includes holes 545 having chevronic cross sections arranged in annular rings such that concave faces 541 of the cross sections face the anticipated direction 526 of rotation of the rotor 15 (FIG. 1). Preferably, the holes 545 extend from a substantially planar first or upstream surface 530 to an opposed substantially planar second or downstream surface (not shown) in parallel, or at an acute angle, with respect to the axis 20 (FIG. 1). Most preferably, the holes 545 are arranged along arcs or curves 590 coincident with anticipated stock flow lines (not shown) immediately above the upstream surface 530 of the bedplate 510 and are oriented such that the holes 545 present the sharpest possible downstream side edges 555 to the anticipated stock flow (not shown). Once again, it will be understood that the particular shapes, sizes, configurations, number and arrangement of the holes 545 shown in FIG. 9 is not critical to the invention and that other suitable shapes, sizes, configurations, numbers and arrangements of holes (not shown) will be apparent to those of ordinary skill in the art.

Figure 10:
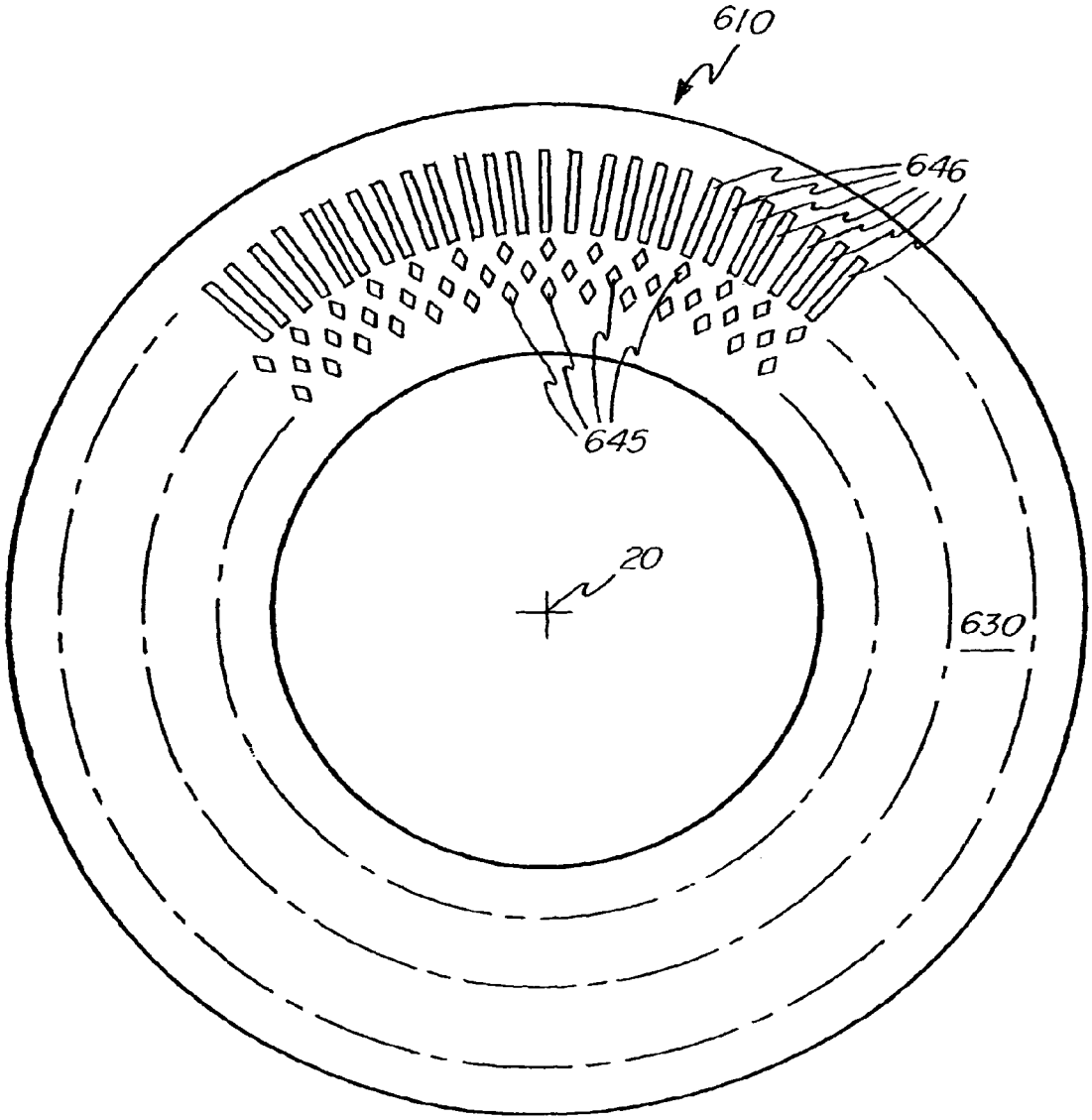
FIG. 10 is a plan view of a portion of a sixth preferred extraction bedplate in accordance with the present invention with holes having chevronic cross sections.

Turning to FIG. 10, a seventh preferred extraction bedplate 610 in accordance with the present invention includes a plurality of holes 645 having rhombic cross sections and a plurality of elongated rectangular slots or holes 646. The holes 645 are arranged in annular rings and are oriented such that major diagonals of the rhombi extend radially with respect to the axis 20. The rectangular slots 646 are arranged in an annular ring surrounding the holes 645 and are elongated in a radial direction relative to the axis 20. Preferably, the holes 645, 646 extend from a substantially planar first or upstream surface 630 to an opposed substantially planar second or downstream surface (not shown) in parallel, or at an acute angle, with respect to the axis 20. Once again, it will be understood that the particular shapes, sizes, configurations, number and arrangement of the holes 645, 646 shown in FIG. 10 is not critical to the invention and that other suitable shapes, sizes, configurations, numbers and arrangements of holes (not shown) will be apparent to those of ordinary skill in the art.

From the foregoing, it will be apparent that the extraction bedplates in accordance with the present invention, including the preferred extraction bedplates 10 (FIGS. 2-5), 210 (FIG. 6), 310 (FIG. 7), 410 (FIG. 8), 510 (FIG. 9), 610 (FIG. 10), are adapted to provide high densities of holes 45 (FIGS. 2-5), 245 (FIG. 6), 345 (FIG. 7), 445 (FIG. 8), 545 (FIG. 9), 645 (FIG. 10) and 646 (FIG. 10) so as to improve the generation of hydraulic shear near the upstream surfaces 30 (FIGS. 2-5), 230 (FIG. 6), 330 (FIG. 7), 430 (FIG. 8), 530 (FIG. 9), 630 (FIG. 10) thereof during pulping operations. Furthermore, it will be apparent that extending the holes 45 (FIGS. 2-5), 245 (FIG. 6), 345 (FIG. 7), 445 (FIG. 8), 545 (FIG. 9), 645 (FIG. 10) and 646 (FIG. 10) through the bedplates 10 (FIGS. 2-5), 210 (FIG. 6), 310 (FIG. 7), 410 (FIG. 8), 510 (FIG. 9), 610 (FIG. 10) at acute angles relative to an axis 20 (FIGS. 1, 2 and 10) thereof serves to reduce drag on the accepts flow through the holes and to improve the generation of hydraulic shear.

Figure 11:
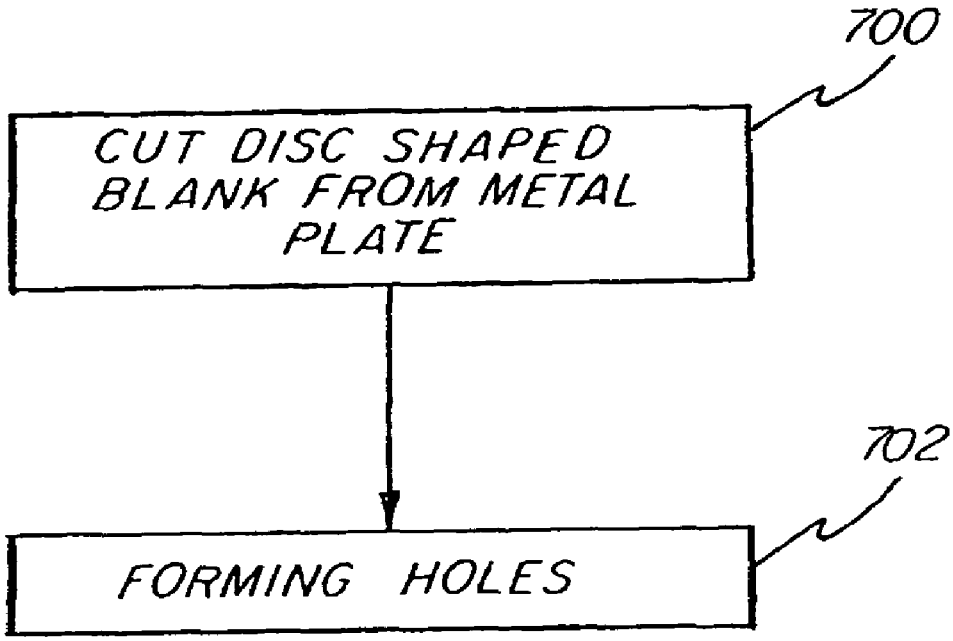
FIG. 11 is a schematic view of a seventh preferred extraction bedplate in accordance with the present invention with a combination of holes having rhombic cross sections and rectangular slots.

Turning to FIG. 11, a preferred method for manufacturing the extraction bedplates 10 (FIGS. 2-5), 210 (FIG. 6), 310 (FIG. 7), 410 (FIG. 8), 510 (FIG. 9), 610 (FIG. 10) from a metal plate (not shown) includes the step 700 of cutting a disc shaped blank (not shown) from the metal plate and the step 702 of forming the holes 45 (FIGS. 2-5), 245 (FIG. 6), 345 (FIG. 7), 445 (FIG. 8), 545 (FIG. 9), 645 (FIG. 10) and 646 (FIG. 10) in either the metal plate or the disc shaped blank. The order of the steps 700 and 702 is not critical to the invention.

The step 700 of cutting the disc shaped blank (not shown) from the metal plate (not shown) may be performed by any of a number of suitable techniques well known to those of ordinary skill in the art. Preferably, the step 700 includes cutting a circular central opening (e.g., 40 in FIG. 2) to accommodate the rotor 15 (FIG. 1). Optionally, the step 700 includes any suitable known surface finishing or metallurgical treatment of the disc shaped blank (not shown) to secure desirable strength, wear resistance or smoothness properties. The manner in which step 702 is performed is not critical to the present invention and numerous options will be apparent to those of ordinary skill in the art.

The step 702 is preferably performed using a cutting stream (not shown) such as an energy stream (not shown) or a fluid stream (not shown). The preferred energy stream (not shown) comprises focused laser light (not shown), although other suitable electromagnetic or thermal energy streams (not shown) including without limitation cutting torches (not shown) may be used. Preferred fluid streams (not shown) include jets (not shown) of water or other fluids.

Optionally, the method includes the additional step (not shown) of securing the wearstrips (70, 71 in FIG. 2) on the upstream and downstream surfaces of the bedplates 10 (FIGS. 2-5), 210 (FIG. 6), 310 (FIG. 7), 410 (FIG. 8), 510 (FIG. 9), 610.

The use of a laser or water jet to form the holes simplifies the manufacture of the bedplates and reduces the both time and cost of manufacture. The method also facilitates the cutting of the non-circular cross sections of the holes as well as the cutting of the holes at an acute angle from the axis 20 (FIGS. 1, 2 and 10), thereby improving the performance of the bedplates. Furthermore, the use of a laser or water jet to form the holes enables the cutting of stronger, more wear resistant metals than those typically used in the prior art, thereby permitting the fabrication of thinner bedplates and of bedplates having useful lives longer than those typical in the prior art.

What is claimed is:

1. A pulper extraction bedplate for use in defiberizing stock for making paper, comprising:

a plate defining first and second planar surfaces; and a plurality of holes extending from said first surface to said second planar surface, said holes having substantially rhombic cross sections and permitting passage of defiberized stock therethrough.

2. A pulper extraction bedplate as recited in claim 1, wherein said plate defines an axis normal to said first and second surfaces and wherein said holes extend at an acute angle with respect to said axis.

3. A pulper extraction bedplate for use in defiberizing stock for making paper, comprising:

a plate defining first and second surfaces; and a plurality of holes extending from said first surface to said second surface, said holes having substantially rhombic cross sections and being arranged along arcs coincident with stock flow lines immediately above the first surface of said bedplate and permitting passage of defiberized stock therethrough.

4. A pulper extraction bedplate for use in defiberizing stock for making paper comprising:

a plate defining first and second surfaces; and a plurality of holes extending from said first surface to said second surface, wherein said plate defines a central axis normal to said first and second surfaces; said holes being arranged along arcs coincident with anticipated stock flow lines immediately above the first surface of said bedplate; and said holes extending through said bedplate at an acute angle along said anticipated stock flow lines so as to define relatively sharp downstream edges facing said anticipated flow lines, wherein said holes have substantially rhombic cross sections and permit passage of defiberized stock therethrough.

5. A pulper extraction bedplate as recited in claim 4 wherein said rhombic shaped holes comprise major diagonal directions and minor diagonal directions with said major diagonal directions extending generally radially relative to said central axis.

6. A pulper extraction bedplate as recited in claim 4 wherein said rhombic shaped holes comprise an upstream surface and a downstream surface located along said first surface of said plate, said downstream surface comprising a pair of straight edges angularly connected to each other at a vertex.

7. A pulper extraction bedplate for use in defiberizing stock for making paper comprising:

a plate defining first and second surfaces; and a plurality of holes extending from said first surface to said second surface, said hole each further having an upstream surface and a downstream surface located along said first surface of said plate, said downstream surface comprising a pair of straight edges angularly connected to each other at a vertex, wherein said holes have a substantially rhombic shaped cross section and permit passage of defiberized stock therethrough.

8. A pulper extraction plate bedplate as recited in claim 7 wherein said plate comprises a central axis extending perpendicularly through said first and second surfaces and wherein said rhombic shaped cross section holes each comprise a major diagonal direction and a minor diagonal direction with said major diagonal direction extending generally radially relative to said central axis.

* * * * *